US006375046B1

(12) United States Patent
Alleard et al.

(10) Patent No.: US 6,375,046 B1
(45) Date of Patent: Apr. 23, 2002

(54) POUCH RESERVOIR VALVE

(75) Inventors: Jean-Pierre Alleard; Jean-Louis Bougamont, both of Eu; Bernard Clerget, Haudivilliers, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/807,969

(22) PCT Filed: Oct. 28, 1999

(86) PCT No.: PCT/FR99/02625

§ 371 Date: Apr. 27, 2001

§ 102(e) Date: Apr. 27, 2001

(87) PCT Pub. No.: WO00/24651

PCT Pub. Date: May 4, 2000

(30) Foreign Application Priority Data

Oct. 28, 1998 (FR) ..... 98 13503

(51) Int. Cl.[7] ..... B65D 83/42

(52) U.S. Cl. ..... 222/386.5; 222/96; 222/1; 222/402.16; 222/402.24; 141/3; 141/20

(58) Field of Search ..... 222/96, 386.5, 222/1, 402.16, 402.24; 141/3, 20

(56) References Cited

U.S. PATENT DOCUMENTS 2,839,225 A * 6/1958 Soffer et al. ..... 222/402.16
3,823,849 A * 7/1974 Ruscitti ..... 222/96
4,979,652 A * 12/1990 Saulle ..... 222/402.16

* cited by examiner

*Primary Examiner*—J. Casimer Jacyna
(74) *Attorney, Agent, or Firm*—Bacon & Thomas, PLLC

(57) ABSTRACT

The invention provides a valve of the type comprising firstly a cylindro-conical body (11) which defines at least part of a chamber (10) for connection via a first end to a deformable bag (P) forming a reservoir for a substance (L) and via a second end to a nozzle tube (T) provided with an admission orifice (a) and with a valve member, and secondly a collar (12) for leak-proof fixing to a rigid case (B) suitable for containing said bag (P) and a gas (A) under pressure; the wall of said body being provided with at least one orifice (15) for injecting the gas (A) providing communication between the chamber (10) and the case (B) and suitable for being closed in leak-proof manner by an elastically-deformable wall bearing against said body (11) around said orifice, the valve being characterized in that said injection orifice (15) is formed in the side wall of said body and the elastically-deformable wall is carried by a sleeve (M) clamped radially around said body (11) and secured to an annular gasket (J) mounted beneath said collar (12).

10 Claims, 2 Drawing Sheets

POUCH RESERVOIR VALVE

BACKGROUND OF THE INVENTION

The present invention relates to a valve for a flexible reservoir for a substance in liquid or gel form, to the use of such a valve for making a device for packaging and dispensing substance, and to a method of packaging such a substance.

Valves already exist for delivering a substance contained in a flexible reservoir implemented in the form of a deformable bag that is enclosed in a rigid case in which there exists gas at a positive pressure.

The function of the compressed gas is to transmit a fraction of its energy (stored in the form of pressure) to the flexible reservoir and to the incompressible liquid substance so as to enable it to be ejected.

In general, such valves comprise firstly a cylindro-conical body defining at least part of a chamber for connection via a first end to a deformable bag forming a reservoir for substance and via a second end to a nozzle tube provided with an admission orifice and with a valve member, and secondly a collar for fixing in leak-proof manner to a rigid case suitable for containing said bag and a gas under pressure.

However, packaging devices fitted with a such valves present filling problems.

The substance is introduced into the bag directly through its mouth if the valve has not yet been mounted, or via the valve chamber if the valve is already in place.

The compressed gas is then injected into the volume lying between the inside wall of the case and the outer skin of the bag already full of substance via an independent orifice fitted with a specific valve.

The compartment for substance and the compartment for gas of the device are therefore filled in two successive operations, sometimes in the opposite order to that described above, but always via two distinct paths, thus requiring two different tools to be used.

An object of the present invention is to resolve these technical problems in satisfactory manner, in particular by simplifying the packaging method by using a single tool for filling purposes.

According invention, this objet is achieved by means of a valve of the type comprising firstly a cylindro-conical body which defines at least part of a chamber for connection via a first end to a deformable bag forming a reservoir for a substance and via a second end to a nozzle tube provided with an admission orifice and with a valve member, and secondly a collar for leak-proof fixing to a rigid case suitable for containing said bag and a gas under pressure; the valve being characterized in that the wall of said body is provided with at least one orifice for injecting the gas providing communication between the chamber and the case and suitable for being closed in leak-proof manner by an elastically-deformable wall bearing against said body around said orifice.

In a specific embodiment, said injection orifice is formed in the side wall of said body and the elastically-deformable wall is carried by a sleeve radially clamped around said body.

According to an advantageous characteristic, said nozzle tube is carried by a rod forming a valve member and suitable for sliding axially in said chamber to uncover the admission orifice of said tube while being urged by a spring towards a high closed position in which said admission orifice has no communication with the chamber.

In a specific variant, the rod is provided with at least one radial fin whose inside face serves as a bearing surface for the return spring.

According to an advantageous characteristic, said chamber is upwardly defined by at least one internal ring secured to said body and providing sealing, firstly when the valve is in the open position by clamping radially around a nozzle tube, and secondly while the valve is in the closed position, by bearing axially against said radial fin.

In a variant, said valve further comprises a coaxial outer ring fitted to the nozzle tube and acting in the valve closed position to wipe and close the admission orifice.

According to yet another characteristic, the collar is connected to the upper portion of said body by forming a shoulder.

In another variant, the admission orifice of the nozzle tube is situated in the side wall thereof.

In yet another variant, said sleeve is secured to an annular gasket mounted beneath said collar.

In a particular embodiment, said bag is connected to the chamber in strong and leak-proof manner by fastening to the wall of said body beneath the injection orifice.

In a variant, said chamber is extended inside the bag by a dip tube.

The invention also provides the use of the above-defined valve for making a device for packaging and dispensing a substance in liquid or gel form.

The invention also provides a method of packaging a substance in liquid or gel form in a reservoir formed by a deformable bag fitted with a valve whose body is provided with at least one injection orifice suitable for being closed by an elastically-deformable wall bearing against said body around said orifice, and designed to be enclosed under the pressure of a gas in a hermetic, rigid case, the method being characterized in that:

- said valve is opened to put the bag into communication with the outside;
- the bag is filled via the valve which is kept open until the level of substance reaches the bottom portion of the body; then
- the gas under pressure is injected into the valve while it is kept in the open position, thereby elastically deforming the wall and uncovering the injection orifice so as to enable the case to be put under pressure; and
- injection of the gas is stopped once the working pressure has been reached, thus causing said wall to return in leak-proof manner against the injection orifice, after which said valve is closed again, thus having the effect of pressing said wall in leak-proof manner against said orifice.

The valve of the invention thus performs two functions. In one direction it enables both the bag to be filled with substance and the case to be filled with drive gas, and in the opposite direction it enables said substance to be ejected without delivering any drive gas.

Packaging operations can thus be implemented in two immediately successive steps by means of a single tool fitted to the nozzle tube.

Consequently, this tool which bears against the nozzle tube can remain in place throughout the entire duration of packaging, thereby providing significant savings in time and in the means implemented.

To perform packaging in full, it suffices to use a set of control cocks and pressure gauges to feed said tool initially with the substance and then with compressed gas.

Furthermore, the valve of invention provides good sealing between the compartments for the substance and for the compressed gas, thus guaranteeing that distribution is of high quality and effectiveness regardless of whether the packaging device is used while it is upright, inclined, lying down, or upside-down.

BRIEF DESCRIPTION OF THE DRAWINGS

The invention will be better understood on reading the following description accompanied by drawings, in which.

DETAILED DESCRIPTION OF THE INVENTION

Figure 2:
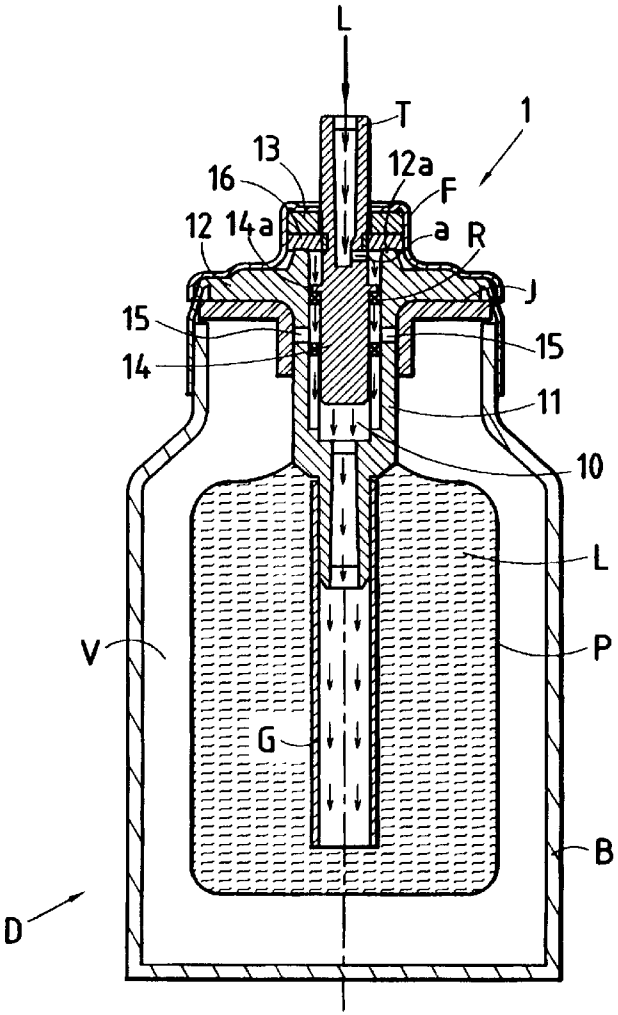
FIGS. 1 to 4 are section views of an embodiment of the valve of the invention mounted on a packaging and dispenser device and shown during successive stages during filling.

The valve 1 shown in figures is mounted on a packaging and dispenser device D for a substance L in a liquid or gel form (e.g. a cosmetic).

The valve comprises a cylindro-conical body 11 which defines at least part of an internal chamber 10 for connection via a first end to a deformable bag P forming the reservoir for substance L, and via a second end to a nozzle tube T which projects out from the device D.

The nozzle tube T defines an internal duct which is provided with an admission orifice a disposed on the side wall of the tube T, forming a valve proper.

The valve 1 also has a collar 12 for leak-proof fixing on a rigid hermetic case B suitable for containing both the bag P and a gas under pressure which is contained in the volume V that lies between the inside wall of said case and the outer skin of the bag P. The collar 12 is connected to the top portion of the body 11 so as to form a shoulder.

The chamber 10 is upwardly defined by at least one sealing ring, and in this case by a set of two superposed sealing rings 13, 16, secured to the body 11 and surrounding the nozzle tube T. In the embodiment described, the inner ring 16 is pinched between the outer ring 13 and a ridge 12*a* carried by the collar 12.

The assembly formed by the body 11, the collar 12, and the rings 13 and 16 is assembled together by means of a ferrule F, preferably made out of stamped metal, for example.

The nozzle tube T is carried by a valve-forming rod 14 which is suitable for sliding axially in the chamber 10.

The rod 14 is provided with at least one radial fin 14*a* whose outside face comes into abutment against the inside face of the ring 16, and whose inside face serves as a bearing point for the end turn of the spring R. The inner ring 16 provides sealing firstly when the valve is in the open position by clamping radially around the nozzle tube T, and secondly when the valve is closed by bearing axially against the radial fin 14*a*. The outer ring 13 is coaxial with and diametrally fitted on the nozzle tube. It serves to wipe and close the orifice a, thereby preventing any substance L from leaving the duct of the tube T after the valve has been used. The chamber 10 is connected to the bag by means of fastening provided either by heat sealing or by vibration, or indeed by adhesive or by mechanical assembly to the wall of the body 11, and the chamber can advantageously extend inside the bag P in the form of a dip tube G.

Sliding contact is provided between the rod 14 and the inside wall of the chamber 10 by the side face of the fin 14*a* acting as a spacer. The wall of the body 11 is provided with at least one orifice, and in embodiment shown with two orifices 15, providing communication between the chamber 10 and the volume V that extends between the wall of the case B and the bag P. In this case, the orifices 15 are formed in the side wall of the body 11, above the zone where the bag P is fixed, and they are suitable for being closed by an elastically-deformable wall bearing against the body 11 around the orifices 15. In this case, the wall is carried by a sleeve M surrounding said body. The sleeve M is secured to an annular gasket J mounted beneath the collar 12 of the valve.

Figure 1:
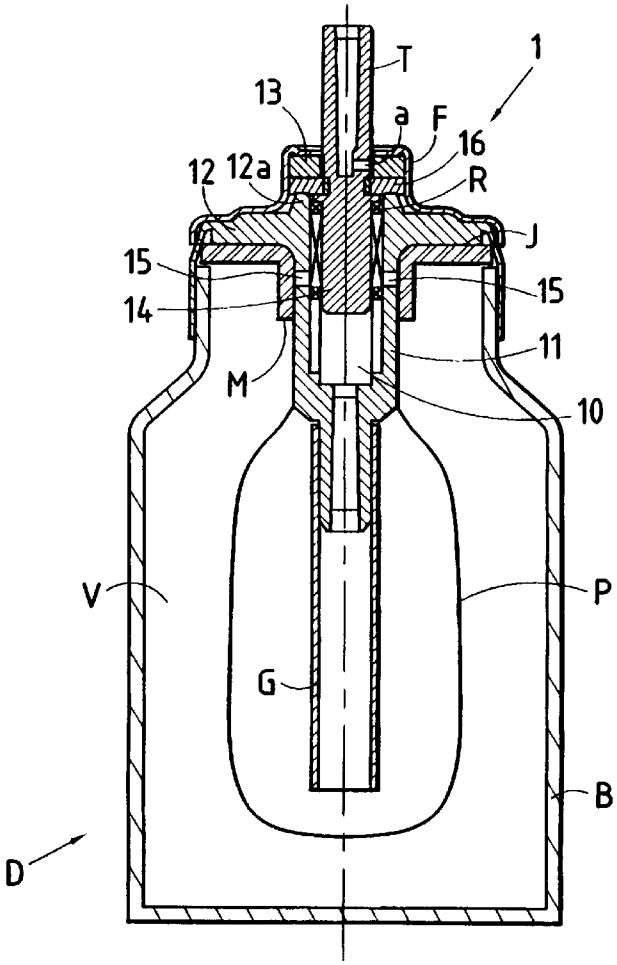

In the closed position shown in FIG. 1, the rod 14 is in its high position and the admission orifice a of the nozzle tube T is masked by the thickness of the outer ring 13, beyond the inner sealing ring 16.

The rod 14 is caused to slide downwards in particular by bearing against the tube T either by hand or by means of a special tool mounted on the tube T. This sliding is accompanied by the return spring R being compressed, which spring is mounted in the chamber 10 coaxially around said rod.

The result of this displacement is to open the valve 1 by uncovering the admission orifice a of the nozzle tube T which then communicates via the chamber 10 with the bag P (see FIG. 2). The stroke of the rod 14 is limited by contact with the turns of the spring R itself bearing against the end wall of the chamber 10. In the low abutment position, the side orifices 15 of the body 11 are still situated beneath the fin 14*a* of the rod 14.

When the valve 1 is in the open position, the bag communicates with the outside. It is then possible to fill the bag P with substance by means of a special tool (not shown) which is connected to the projecting end of the nozzle tube T. This tool enables the valve to be kept open by bearing against the tube T during filling, and filling is continued until the level of substance L reaches the bottom portion of the chamber 10.

The tool is also adapted thereafter to inject a gas A under pressure (e.g. nitrogen) still via the tube T, and while continuing to press against the tube T.

Since the bag is a deformable but inextensible, and since at this stage of packaging it is already full of an incompressible liquid substance L, the gas A injected under pressure begins by occupying the chamber 10. Then, as injection continues, the pressure in the chamber 10 rises because of the obstacle formed by the substance L, thereby moving the elastically-deformable wall carried by the sleeve M.

Figure 3:
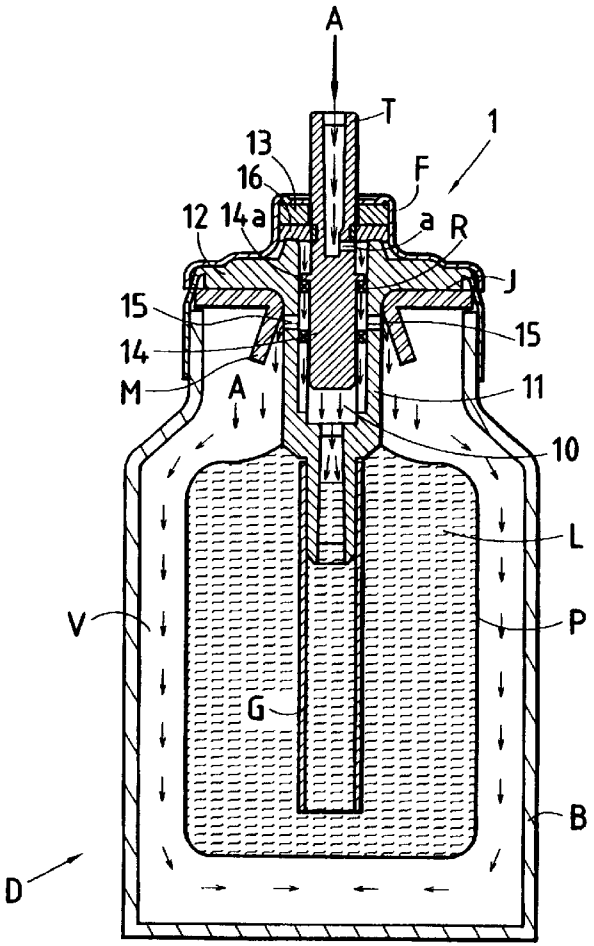

The deformable wall then moves away from the rigid wall of the body 11, thereby uncovering the side orifices 15 (see FIG. 3).

The gas A under pressure thus enters into the intermediate volume V. Gas injection is stopped when the pressure in the volume V reaches a predetermined "working pressure" value which corresponds to sufficient energy being stored to enable all of the substance contained in the bag P to be ejected automatically. Stopping injection causes the pressures on either side of the injection orifices 15 to come into equilibrium. The effect of this equilibrium is to return the sleeve M into its rest position against the orifices 15 because of the shape memory of its component material. Removing the tool ensures that the valve closes by the nozzle tube T rising, thus increasing the volume of the chamber 10 and generating a drop in its internal pressure. A pressure difference is then established between the chamber 10 and the volume V, thus causing the sleeve M to be pressed against the side wall of the body 11 and closing the orifices 15 in leak-proof manner.

Figure 4:
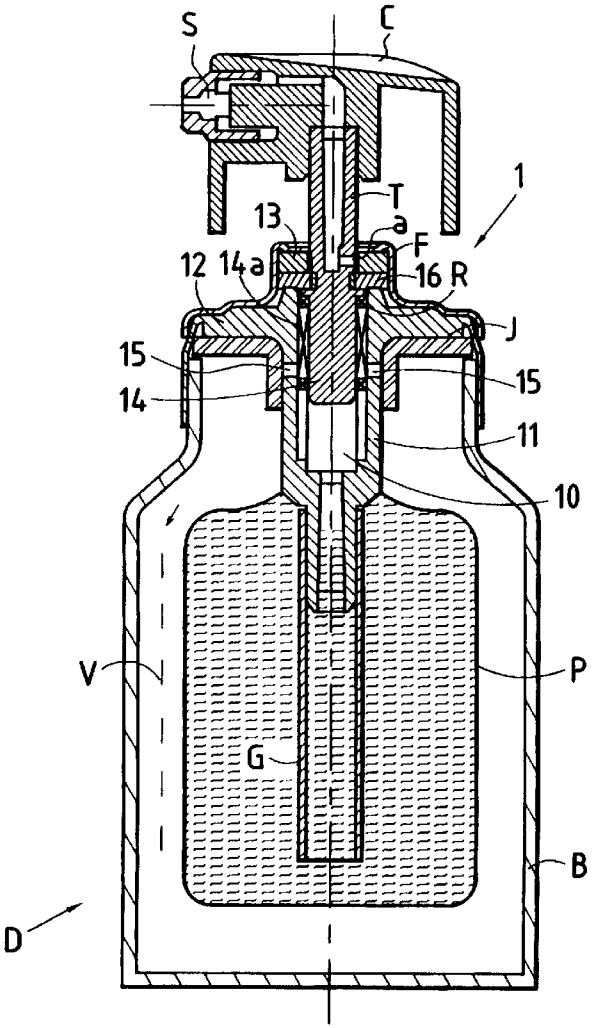

After packaging, a push-button c, where appropriate fitted with a spray nozzle S, is mounted on the end of the nozzle tube T (see FIG. 4).

What is claimed is:

1. A method of packaging a substance (L) in liquid or gel form in a reservoir formed by a deformable bag (P) fitted with a valve (1) whose body (11) which defines at least part of a chamber (10) is provided with at least one injection orifice (15) suitable for being closed by an elastically-deformable wall bearing against said body around said orifice, and designed to be enclosed under the pressure of a gas (A) in a hermetic, rigid case (B) by leaving an intermediate volume (V), the method comprising the steps:

opening said valve (1) to put the bag (P) into communication with the outside;

filling the bag (P) via the valve (1) while the valve is kept open until the level of substance (L) reaches the bottom portion of the body (11); then injecting the gas (A) under pressure into the valve (1) while it is kept in the open position, thereby moving the elastically-deformable wall and uncovering the injection orifice (15) so as to enable the case (B) to be put under pressure; and stopping injection of the gas (A) once the working pressure has been reached and said valve is closed again without putting the chamber (10) into communication with the atmosphere, thus establishing pressure equilibrium on either side of the orifice (15) and enabling said wall to return in leak-proof manner against the injection orifice (15) so that as soon as the valve (1) is first opened, a pressure difference exists between the volume (V) and the chamber (10), thereby enabling said wall to be pressed in leak-proof manner against said orifice (15).

2. A valve comprising a cylindro-conical body (11) which defines at least part of a chamber (10) for connection via a first end to a deformable bag (P) forming a reservoir for a substance (L) and via a second end to a nozzle tube (T) provided with an admission orifice (a) and with a valve member; a collar (12) for leak-proof fixing to a rigid case (b) suitable for containing said bag (P) and a gas (A) under pressure; the wall of said body being provided with at least one orifice (15) for injecting the gas (A) providing communication between the chamber (10) and the case (B) and suitable for being closed in leak-proof manner by an elastically-deformable wall bearing against said body (11) around said orifice; said injection orifice (15) being formed in the side wall of said body and wherein the elastically-deformable wall is carried by a sleeve (M) clamped radially around said body (11) and secured to an annular gasket (J) mounted beneath said collar (12).

3. A valve according to claim 2, wherein said nozzle tube (T) is carried by a rod (14) forming a valve member and is arranged to slide axially in said chamber to uncover the admission orifice (a) of said tube (T), and a return spring (R) urging said tube (T) towards a high closed position in which said admission orifice (a) has no communication with the chamber (10).

4. A valve according to claim 3, wherein said rod (T) is provided with at least one radial fin **(14*a*)** whose inside face serves as a bearing surface for the return spring (R).

5. A valve according to claim 2, wherein said chamber (10) is upwardly defined by at least one internal ring (16) secured to said body (11) and providing sealing, firstly when the valve is in the open position by clamping radially around a nozzle tube (T), and secondly while the valve is in the closed position, by bearing axially against said radial fin **(14*a*)**.

6. A valve according to claim 5, further comprising a coaxial outer ring (13) fitted to the nozzle tube and acting in the valve closed position to wipe and close the admission orifice (a).

7. A valve according to claim 2, wherein said collar (12) is connected to the upper portion of said body (11) by forming a shoulder.

8. A valve according to claim 2, wherein the admission orifice (a) of the nozzle tube (T) is situated in the side wall (7) thereof.

9. A valve according to claim 2, wherein said bag (P) is connected to the chamber (10) in strong and leak-proof manner by fastening to the wall of said body (11) beneath the injection orifice (15).

10. A valve according to claim 2, wherein said chamber (10) is extended inside the bag (P) by a dip tube (G).

* * * * *